US010499148B2

(12) United States Patent
Georgi et al.

(10) Patent No.: US 10,499,148 B2
(45) Date of Patent: Dec. 3, 2019

(54) WIRELESS MICROPHONE AND/OR IN EAR MONITORING SYSTEM AND METHOD OF CONTROLLING A WIRELESS MICROPHONE AND/OR IN-EAR MONITORING SYSTEM

(71) Applicant: Sennheiser electronic GmbH & Co. KG, Wedemark (DE)

(72) Inventors: Sebastian Georgi, Langenhagen (DE); Jan Wetermann, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 16/090,970

(22) PCT Filed: Apr. 4, 2017

(86) PCT No.: PCT/EP2017/058003
§ 371 (c)(1),
(2) Date: Oct. 3, 2018

(87) PCT Pub. No.: WO2017/174589
PCT Pub. Date: Oct. 12, 2017

(65) Prior Publication Data

US 2019/0141440 A1 May 9, 2019

(30) Foreign Application Priority Data

Apr. 4, 2016 (DE) ..... 10 2016 106 105

(51) Int. Cl.
*H04R 3/00* (2006.01)

(52) U.S. Cl.
CPC ..... *H04R 3/00* (2013.01); *H04R 2420/07* (2013.01)

(58) Field of Classification Search
CPC ..... H04R 2420/07; H04R 3/00
(Continued)

(56) References Cited

U.S. PATENT DOCUMENTS 6,456,614 B1 * 9/2002 Guan ..... H04B 7/2681 370/343
2014/0143582 A1 * 5/2014 Kindred ..... G06F 1/12 713/400

(Continued)

FOREIGN PATENT DOCUMENTS

| | | |
|---|---|---|
| EP | 2736274 | 5/2014 |
| WO | WO 02/07479 | 1/2002 |
| WO | WO 2015/038776 | 3/2015 |

OTHER PUBLICATIONS

International Search Report for Application No. PCT/EP2017/058003 dated Jun. 8, 2017.

*Primary Examiner* — Paul Kim
*Assistant Examiner* — Friedrich Fahnert
(74) *Attorney, Agent, or Firm* — Haug Partners LLP

(57) ABSTRACT

A wireless microphone and/or in-ear monitoring system having a clock master prescribing a wordclock, and a clock slave to be synchronized to the wordclock. Between the clock master and the clock slave is a digital wireless transmission link which digitally transmits synchronization signals and audio signals. The clock master has a clock reference prescribing a first sample clock, and a first timer. A first phase of the first clock signal is detected after expiry of the first timer and is wirelessly transmitted to the clock slave, which has a second timer. After expiry of the second timer, a second phase of the second clock signal of the clock slave is detected and compared to the wirelessly transmitted first phase. The difference between the first and second phases is used as an input value as a control unit in the clock slave. The control unit adjusts an adjustable sample clock of the clock slave to correspond to the first clock.

7 Claims, 2 Drawing Sheets

(58) Field of Classification Search
USPC ..... 381/14, 59, 77, 97, 98, 111, 311; 713/400; 370/343
See application file for complete search history.

(56) References Cited

U.S. PATENT DOCUMENTS

| | | | | |
|---|---|---|---|---|
| 2016/0211935 | A1* | 7/2016 | Fair | G06F 1/12 |
| 2016/0269136 | A1* | 9/2016 | Fair | G06F 1/12 |
| 2017/0099644 | A1* | 4/2017 | Kindred | G06F 1/12 |

* cited by examiner

WIRELESS MICROPHONE AND/OR IN EAR MONITORING SYSTEM AND METHOD OF CONTROLLING A WIRELESS MICROPHONE AND/OR IN-EAR MONITORING SYSTEM

The present application claims priority from International Patent Application No. PCT/EP2017/058003 filed on Apr. 4, 2017, which claims priority from German Patent Application No. DE 10 2016 106 105.0 filed on Apr. 4, 2016, the disclosures of which are incorporated herein by reference in their entirety.

FIELD OF THE INVENTION

It is noted that citation or identification of any document in this application is not an admission that such document is available as prior art to the present invention.

The invention concerns a wireless microphone and/or in-ear monitoring system and a method of controlling a wireless microphone and/or in-ear monitoring system.

Wired digital audio processing systems typically use a so-called wordclock as a base clock which is required to permit transmission of audio data streams between digital audio devices. A wordclock is used to synchronize all units or devices involved in the digital audio processing in respect of the sampling times of the audio signals being processed. The various digital audio devices which are to be synchronized by means of the wordclock can represent for example AD-converters, effect devices, mixing desks, DA-converters and so forth. Those audio devices typically have digital interfaces like for example AES3/SPDIF, AES10/MADI. Based on the wordclock synchronization it is possible to ensure a continuous transfer of audio samples whereby it is possible to prevent a buffer from running dry or overflowing. It is possible to achieve a synchronous phase position of the audio signals by virtue of the wordclock synchronization. When using a plurality of microphones for example that signifies that all microphones synchronized by way of the wordclock respectively simultaneously produce a digital sample of the respective microphone signal. The devices used in digital audio processing typically have an internal clock generator which affords a base clock with which the digital sample values of the audio data are processed. If however there are a plurality of digital audio devices a wordclock is prescribed as the master clock and adopted by the devices involved as slaves. For that purpose a signal is made available by the wordclock master by way of a cable, which signal cyclically contains a stimulus for each individual sampling time and the slave device can continuously adapt the inherent clock generator thereof by means of that signal to the sampling clock coming from the wordclock master.

Such wordclock synchronization is however known only in relation to wired digital audio processing devices.

SUMMARY OF THE INVENTION

The object of the invention is to permit synchronization of the wordclocks of various audio processing units in a wireless microphone and/or in-ear monitoring system.

Thus there is provided a wireless microphone and/or in-ear monitoring system which has at least one clock master for prescribing a wordclock and at least one clock slave which is to be synchronized to the wordclock prescribed by the clock master. Provided between the clock master and the at least one clock slave is a digital wireless transmission link which digitally transmits both synchronization signals and also audio signals. The clock master has a clock reference to prescribe a first sample clock. The clock master further has a synchronization interface for wirelessly transmitting a synchronization word. The clock master has a first timer. A first phase of the first clock signal is detected after expiry of the first timer and the first phase is wirelessly transmitted to the at least one clock slave. The at least one clock slave has a second timer. After expiry of the second timer a second phase of the second clock signal of the clock slave is detected and compared to the wirelessly transmitted first phase. The difference between the first and second phases is used as an input variable to a control unit in the at least one clock slave. The control unit adjusts an adjustable sample clock of the at least one clock slave such that it corresponds to the first clock of the clock master.

According to the invention there is provided a wireless microphone and/or in-ear monitoring system which has wireless digital transmission. For wireless digital transmission of an audio signal the audio signal must be subjected to digital/analog conversion. Analog/digital conversion is carried out at fixed time intervals, based on a sample clock. A further device which receives the audio signal sent by way of the wireless digital transmission link should as far as possible use the same sample clock. If however the sample clock is generated in the further device itself then it can differ slightly from the sample clock of the transmitting device by virtue of tolerances in the electronic components used and/or temperature differences. Appropriate transmission of space-related multi-channel signals (stereo, surround systems [for example 5.1]) can function only limitedly as a result; acoustic spatial localization becomes very inaccurate as a result, sometimes impossible. This means that synchronization of the sample clock is required in frequency and also in phase.

Wireless wordclock synchronization for synchronous analog/digital and digital/analog conversion can be used in wireless audio devices like for example wireless microphones and wireless in-ear monitoring receivers, by virtue of the wireless microphone and/or in-ear monitoring system according to the invention. The advantage of a wireless wordclock synchronization arises in particular in the case of microphoning suitable for stereo and surround sound having a plurality of wireless microphones and/or wireless in-ear monitoring receivers. In addition this can avoid sample rate conversion which is otherwise required in order to output a plurality of incoming channels (for example from a plurality of microphones) on a common mix channel.

BRIEF DESCRIPTION OF THE DRAWINGS

Advantages and embodiments by way of example of the invention are described more fully hereinafter with reference to the drawings.

DETAILED DESCRIPTION OF EMBODIMENTS

Figure 1:
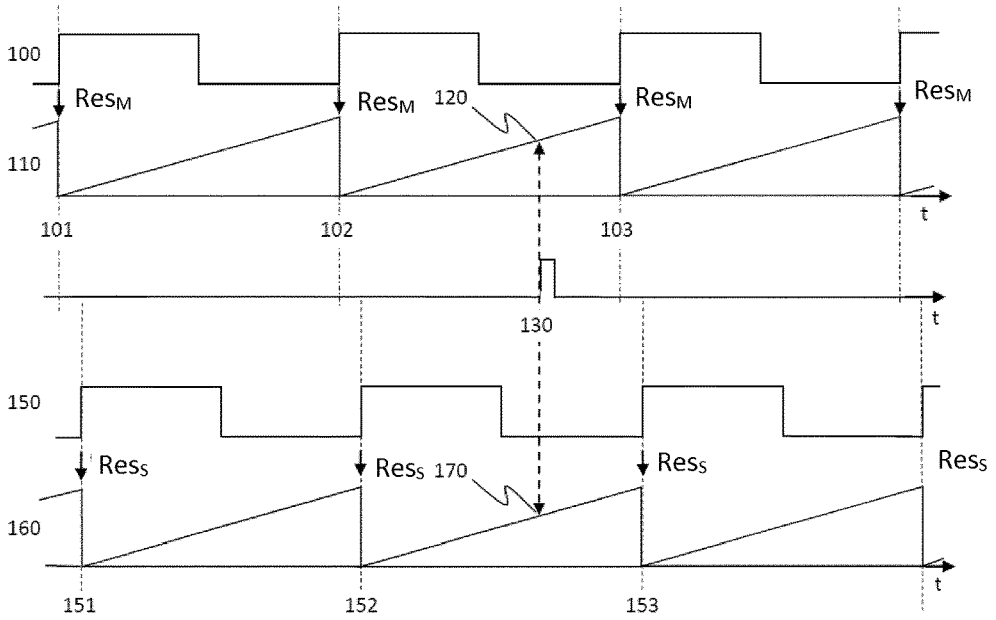
FIG. 1 shows a time plot of signals which are used in a clock master and a clock slave according to a first embodiment for sampling time synchronization.

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

The problem to be dealt with is based on the fact that in digital detection, processing and output of audio data at given times sample values of the analog audio signals are generated. That can be effected for example at a frequency of 48 kHz. If the devices are operating with different sample rates then sample rate conversion is necessary when passing the audio data to another device, in which conversion sample values have to be estimated between the actual sampling times, and that leads to artefacts which make themselves noticeable as so-called "phase noise". The same problem arises when a plurality of devices for digital audio processing nominally operate with the same sample rate but respectively generate the nominal clock rate independently of each other themselves. Just slight differences in the actual sample rates have the result that a different number of sample values is generated or processed between the individual devices over a completed period of time being considered, so that here too sample rate conversion is required for transmission to another device. The above-described wordclock synchronization is known as a remedy in the case of wired devices. In that case the sampling times, that is to say the times at which a respective digital sample value in relation to an analog audio signal is generated, processed or output, are synchronized between all correspondingly connected devices. The known wired transmission of the wordclock signal is based on the aspect that there is a delay-free link available at any time by way of the cable between the wordclock master and the respective wordclock slave, by way of which the signal which cyclically contains a stimulus for each individual sampling time, is provided. The slave device can thus continuously adapt its own clock generator on the basis of that signal to the sampling clock coming from the wordclock master.

Such a delay-free link which is available at any time is however not available in the wireless transmission of digital audio data so that wordclock synchronization of the audio sample rate is not possible here in the manner known from wired devices. Instead, for the wireless transmission of data, a specific data synchronization is provided between the transmitter and the receiver, and that permits correct transmission of all contained bits. That data synchronization however is independent of the audio sample rate. Accordingly the audio data are frequently combined in blocks of a plurality of audio samples which are then jointly transmitted at a time established by the wireless data transmission system. For example a time slot method (Time Division Multiple Access, TDMA) can be used for wireless data transmission, which establishes then the times at which an individual device can send data. Those times however are not in any way synchronized with the audio sampling times.

The invention concerns a method and associated devices which permit wordclock synchronization of the audio sampling times in the wireless transmission of digital audio data.

According to the invention there is provided a wireless microphone and/or in-ear monitoring system. In the system for example wireless microphones can transmit an audio signal detected by them wirelessly to a receiver. Additionally or alternatively an audio signal can be wirelessly transmitted to an in-ear monitoring unit so that that audio signal can be output for example by way of an in-ear earphone to a wearer of the in-ear monitoring system.

At least one clock master TM and at least one clock slave TS are present in the wireless microphone and/or in-ear monitoring system. The at least one clock slave must then be adjusted to the clock prescribed by the clock master, for example the wordclock, both in terms of frequency and also in terms of phase.

FIG. 1 shows a time plot of signals which are used in a clock master and a clock slave according to a first embodiment for sampling time synchronization. Shown at the top in FIG. 1 is the master audio sample clock 100 of the clock master in relation to time t. Optionally the master audio sample clock 100 can itself already be matched to a wordclock signal of an external clock generator. For the following considerations however the master audio sample clock 100 is deemed to be the master clock, to which the audio sampling times of the slave device or devices are to be adapted. Associated with the rising edge of the master audio sample clock 100 is a respective audio sampling time at which therefore a sample value of an analog audio signal is to be respectively ascertained, processed or output. The master sampling times 101, 102 and 103 are shown in FIG. 1.

The master device also includes a master fine clock generator which drives a master phase counter. FIG. 1 shows the counter state 110 of the master phase counter in relation to time t. At each sampling time, therefore each time when a master audio sample clock 100 has a positive edge, the counter state 110 of the master phase counter is reset to zero by a reset command ResM. After that the master phase counter counts forward with the clock of the master fine clock generator in single steps at each tic of the master fine clock generator. The counter state 110 therefore specifies with the time resolution of the master fine clock generator, how much time has elapsed since the last master sampling time. For that purpose the master fine clock generator has a clock frequency substantially greater than the audio sampling frequency. For example, with an audio sampling frequency of 48 kHz, it is possible to use a master fine clock generator operating at a frequency of 160 MHz so that the master phase counter reaches approximately a value of 3333 from an audio sampling time to the next audio sampling time (depending on the precise desired audio sample rate). In that case the counter state 110 of the master phase counter represents phase information about the phase of the master audio sample clock 100, that has elapsed since the last audio sample. In order to obtain time resolution of the phase information, that is suitable for audio sample synchronization, the clock of the master fine clock generator should be so selected that, in the period of time from an audio sampling time to the directly following audio sampling time, there are at least 500 tics of the master fine clock generator so that the counter state 110 of the master phase counter counts at least to 500 in each audio sampling step.

Audio sample clocking and phase detection is constructed corresponding to the master device, in the slave device. Shown at the bottom in FIG. 1 is the slave audio sample clock 150 of the clock slave in relation to time t. Associated with a rising edge of the slave audio sample clock 150 is a respective slave audio sampling time 151, 152, 153. The slave audio sample clock 150 is adjustable and the aim of the present invention is to so adjust the slave audio sample clock 150 that the slave audio sampling times 151, 152, 153 correspond to the master audio signals sampling times 101, 102, 103.

The slave device includes a slave fine clock generator driving a slave phase counter. FIG. 1 shows the counter state 160 of the slave phase counter in relation to time t. At each slave sampling time, that is to say each time the slave audio sample clock 150 has a positive edge, the counter state 160 of the slave phase counter is reset to zero in the slave device by a reset command ResS. After that the slave phase counter counts forward in single steps with the clock of the slave fine clock generator at each tic of the slave fine clock generator. The counter state 160 with the time resolution of the slave fine clock generator therefore specifies how much time has elapsed since the last slave sampling time. For that purpose the slave fine clock generator nominally preferably involves the same clock frequency as the master fine clock generator. In that respect the counter state 160 of the slave phase counter represents phase information about the phase of the slave audio sample clock 150, that has elapsed since the last slave audio sample.

FIG. 1 shows a state in which the slave audio sampling times 151, 152, 153 still do not correspond to the master audio sampling times 101, 102, 103.

According to the invention adjustment of the slave audio sample clock 150 to the master audio sample clock 100 is effected by means of a synchronization event which establishes a synchronization time 130.

Preferably the synchronization event which establishes the synchronization time 130 can be obtained from the data synchronization between a transmitter and a receiver. As already explained provided for the wireless transmission of data between a transmitter and receiver there is specific data synchronization which permits correct transmission of the contained bits but which is independent of the audio sample rate. At any event, in the case of wireless data transmission, it is possible to specify times at which the respective data transmission protocol being used produces a fixed time relationship between the master and the slave devices. That can be for example a time slot in the context of a TDMA method in which a control code is transmitted.

According to the invention such an event which produces a fixed time relationship between the master device and the slave device is used in order to cause the master device and the slave device to simultaneously detect the current counter state 110 of the master phase counter and the current counter state 160 of the slave phase counter. In this context "simultaneously" signifies that the time displacement of detection of the counter value between master device and slave device corresponds at maximum to the duration of a tic of the master fine clock generator and thus also of the slave fine clock generator. The master device detects the master phase 120 at the time 130 by reading out the counter state 110 of the master phase counter and the slave device detects the slave phase 170 at the time 130 by reading out the counter state 160 of the slave phase counter.

Besides generation of the synchronization time 130 on the basis of data synchronization it is alternatively possible also to involve another event for establishing the synchronization time 130. The only important consideration is that, at that time, a fixed time relationship is guaranteed between the master device and the slave device, with which simultaneous detection of the master phase 120 and the slave phase 170 (in accordance with the above-discussed definition of "simultaneously") can be carried out.

After detection of the master phase 120 and the slave phase 170 the detected value of the master phase 120 is wirelessly transmitted from the master device to the slave device. In that respect it is irrelevant whether that transmission is in a given time relationship with the synchronization time 130.

According to the invention the slave device receives the measured value of the master phase 120 and compares it to the value of the slave phase 170, measured at the same time 130. The result of that comparison is the control difference in respect of the phase of the slave audio sample clock 150 in relation to the desired phase of the master audio sample clock 100. Accordingly that comparison result is passed as a phase difference to a controller in a "phase-locked loop" (PLL). The controller can influence the clock rate of the slave audio sample clock 150 as a control variable. In a phase locked loop that clock rate is then influenced in such a way that the slave phase 170 corresponds to the master phase 120 after multiple implementation of the control loop. The control involves cyclic repetition of the entire measurement and processing operation for the master phase (120) and the slave phase (170). Adjustment of the clock rate of the slave audio sample clock 150 to the clock rate of the master audio sample clock 100 necessarily occurs as a side effect in control of the phase difference as a target effect.

It is to be emphasized as an important difference in relation to wired wordclock synchronization that there is no need to provide for a synchronization event within each individual sampling step of the master audio sample clock 100, to establish a synchronization time 130. Rather, it is sufficient if such a synchronization event occurs occasionally. For example about 50 sampling steps of the master audio sample clock 100 can take place before a new synchronization event which establishes a new synchronization time 130 takes place. That can be related for example to the above-described wireless transmission of audio data in blocks. There is also no need for the synchronization times 130 to be equidistantly spaced from each other. For the phase locked loop, only recurring implementation of simultaneous detection of the master phase 120 and the slave phase 170 and subsequent processing in the PLL is required.

A particular advantage of the described method according to the invention for adjusting the slave audio sample clock 150 to the master audio sample clock 100 lies in the only short-term utilization of the master fine clock generator and the slave fine clock generator. The fine clock generators also respectively generate their own clock and as this involves separate components—on the one hand in the master device and on the other hand in the slave device—they do not run at exactly the same speed. By virtue of the fact that the counter state 110 of the master phase counter and the counter state 160 of the slave phase counter are reset to zero at each audio sampling time the period of time during which a mutually differing speed of the two fine clock generators has an effect on the phase measurement result is so short that with the generally available clock generators there is a difference of less than a tic in respect of the fine clock generators between the measured master phase 120 and the measured slave phase 170. In accordance with the above-indicated example it is possible to use an audio sampling frequency of 48 kHz and a fine clock generator frequency of 160 MHz so that the phase counters reach approximately a value of 3333 from one audio sampling time to the next audio sampling time. If the speeds of the two fine clock generators were to differ from each other to such an extent that within that period a tic difference between the two fine clock generators already occurs, that would correspond to a clock accuracy of 300 ppm (parts per million), that is to say an error of 300 steps during a period of 1 million tics. In the case of standard clock generators at the present time an accuracy of about 20 ppm is usual and even for example 2.5 ppm can be obtained. The problems of separately running fine clock generators are therefore advantageously circumvented by the short-term use according to the invention of the fine clock generators. Accordingly the method according to the invention affords an advantage over an otherwise possible alternative approach in which a total period of time is ascertained between the synchronization times 130 by means of the fine clock generators and is transmitted jointly with the quantity of the sampling times occurring in that period.

Figure 2:
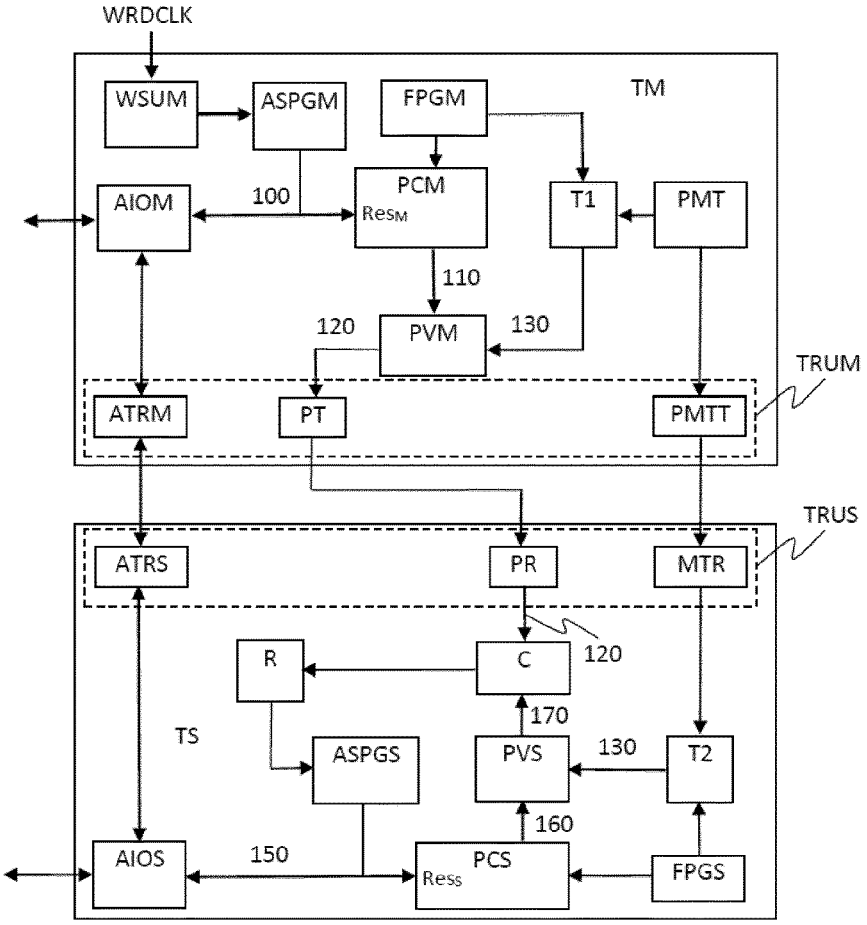
FIG. 2 shows a block circuit diagram of a master device and a slave device according to the first embodiment.

FIG. 2 shows a block circuit diagram of a master device TM and a slave device TS according to the first embodiment. The master device TM includes a master audio sample clock generator ASPGM for generating the master audio sample clock 100. Optionally the master device TM can itself have a wordclock input WRDCLK and a master wordclock synchronization unit WSUM by way of which the master audio sample clock 100 itself can already be adjusted to a wordclock signal of an external clock generator. The master audio sample clock 100 prescribes the clock for a digital master audio input output unit AIOM. The master audio input output unit AIOM serves as an interface for the master device outwardly and can serve to receive and transmit digital audio data.

The master device TM also includes a master fine clock generator FPGM driving a master phase counter PCM. The master phase counter PCM continuously generates the counter state 110. At each sampling time, that is to say each time the master audio sample clock 100 has a positive edge, the counter state 110 of the master phase counter PCM is reset to zero by a reset command ResM. Thereafter the master phase counter PCM counts forwards in single steps with the clock of the master fine clock generator FPGM at each tic of the master fine clock generator. The counter state 110 therefore specifies with the time resolution of the master fine clock generator, how much time has elapsed since the last master sampling time.

Audio sample clocking and phase detection corresponding to the master device TM is constructed in the slave device TS. The slave device TS includes a slave audio sample clock generator ASPGS for generating the slave audio sample clock 150. The slave audio sample clock generator ASPGS is so designed that its clock rate is adjustable within certain limits. The slave audio sample clock 150 prescribes the clock for a digital slave audio input output unit AIOS. The slave audio input output unit AIOS serves as an interface for the slave device outwardly and can serve to receive and transmit digital audio data. If the slave device TS is in the form of a microphone an A/D-converter can be connected to the slave audio input output unit AIOS and provide a digital audio signal as input. If the slave device TS is in the form of an in-ear monitoring system a D/A-converter can be connected to the slave audio input output unit AIOS and a digital audio signal can be output as the output signal.

The slave device TS also includes a slave fine clock generator FPGS driving a slave phase counter PCS. The slave phase counter PCS continuously generates the counter state 160. At each sampling time, that is to say each time the slave audio sample clock 150 has a positive edge, the counter state 160 of the slave phase counter PCS is reset to zero by a reset command ResS. Thereafter the slave phase counter PCS counts forwards in single steps with the clock of the slave fine clock generator FPGS at each tic of the slave fine clock generator. The counter state 160 therefore specifies with the time resolution of the slave fine clock generator, how much time has elapsed since the last slave sampling time.

According to the invention adjustment of the slave audio sample clock 150 to the master audio sample clock 100 is effected by means of a synchronization event which establishes a synchronization time 130. Such a synchronization event can be generated by a phase measurement trigger PMT. Preferably the phase measurement trigger PMT can obtain the synchronization event from data synchronization between a transmitter and a receiver, that is to say in particular from wireless transmission between the master device TM and the slave device TS. The synchronization event can be wirelessly transmitted by way of a phase measurement trigger transmitter PMTT to a measurement trigger receiver MTR in the slave device TS, in which case a fixed time relationship is generated between the master device and the slave device. Optionally the master device TM can contain a timer T1 started by the phase measurement trigger PMT. The timer T1 can be clocked by the master fine clock generator FPGM. Correspondingly the slave device TS can contain a timer T2 which is started when the measurement trigger receiver MTR receives the synchronization event. The timer T2 can be clocked by the slave fine clock generator FPGS. The two timers T1 and T2 can serve to take account of the transmission time required for transmission of the synchronization event. The two timers T1 and T2 are then actuated in such a way that they both run out simultaneously and thus generate the synchronization time 130 simultaneously in the master device TM and in the slave device TS. In this connection "simultaneously" means that the time displacement in respect of detection of the phase counter value between master device and slave device corresponds at maximum to the duration of a tic of the master fine clock generator FPGM and thus also the slave fine clock generator FPGS.

The master device TM also includes a master phase value sensor PVM which at the synchronization time 130 reads out the current counter state 110 of the master phase counter PCM and stores it as a master phase 120. Correspondingly the slave device TS contains a slave phase value sensor PVS which at the synchronization time 130 reads out the current counter state 160 of the slave phase counter PCS and stores it as the slave phase 170.

After detection of the master phase 120 and the slave phase 170 the detected value of the master phase 120 is wirelessly transmitted from the master device TM to the slave device TS. For that purpose the master device TM contains a phase transmitter PT and the slave device contains a phase receiver PR. In that respect it is irrelevant whether that transmission is in a given time relationship with the synchronization time 130.

According to the invention the slave device TS receives the measured value of the master phase 120 and compares it in a comparator C to the value of the slave phase 170, that is measured at the same time 130. The result of that comparison is the control deviation of the phase of the slave audio sample clock 150 in relation to the desired phase of the master audio sample clock 100. Correspondingly that comparative result is fed as a phase difference to a controller R in a "phase locked loop" (PLL). The controller R can influence as a control parameter the clock rate of the slave audio sample clock generator ASPGS and thus the slave audio sample clock 150. In a phase locked loop that clock rate is then influenced in such a way that after multiple implementation of the control loop the slave phase 170 corresponds to the master phase 120. Adaptation of the clock rate of the slave audio sample clock 150 to the clock rate of the master audio sample clock 100 necessarily occurs in that case as a side effect.

The master device TM also includes a master audio transmitter receiver ATRM, by way of which it can wirelessly transmit and/or receive digital audio data which are associated with the master audio sample clock 100 of the master audio sample clock generator ASPGM and the slave device TS also contains a slave audio transmitter receiver ATRS, by way of which it can wirelessly transmit and/or receive digital audio data which are associated with the slave audio sample clock 150 of the slave audio sample clock generator ASPGS. The master audio transmitter receiver ATRM is connected to the master audio input output unit AIOM and the slave audio transmitter receiver ATRS is connected to the slave audio input output unit AIOS.

Optionally the master audio transmitter receiver ATRM, the phase transmitter PT and the phase measurement trigger transmitter PMTT can be combined in a common wireless transmission unit TRUM in the master device TM. Correspondingly, optionally the slave audio transmitter receiver ATRS, the phase receiver PR and the measurement trigger receiver MTR can be combined in a common wireless transmission unit TRUS in the slave device TS.

Figure 3:
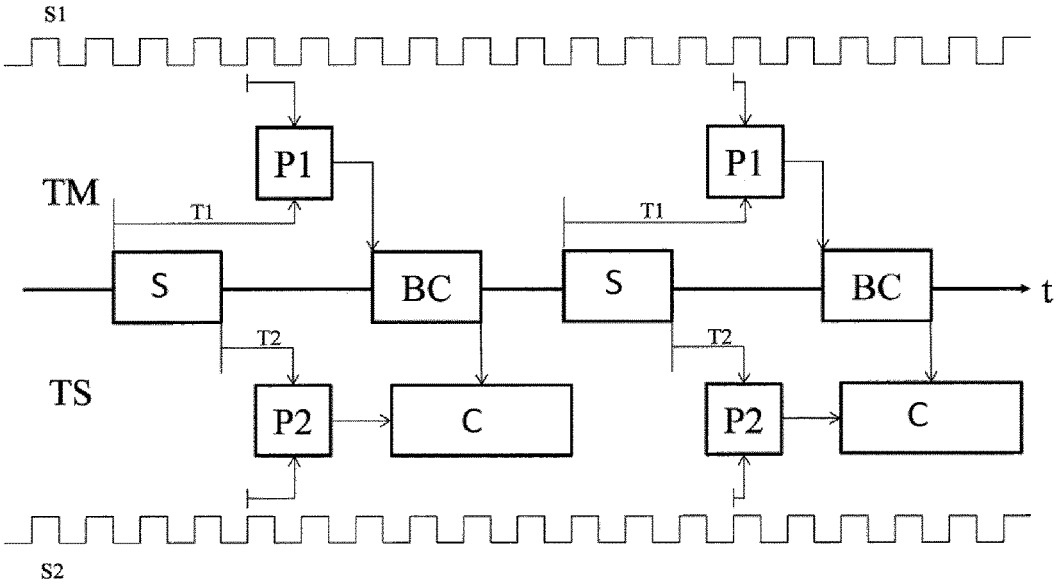
FIG. 3 shows a diagrammatic view of a process of synchronization in a wireless microphone and/or in-ear monitoring system according to a second embodiment.

FIG. 3 shows a diagrammatic view of a process of wordclock synchronization in a wireless microphone and/or in-ear monitoring system according to a second embodiment. The second embodiment of FIGS. 3 and 4 corresponds in many parts to the first embodiment. It will be noted however that in the second embodiment, the way in which generation of the audio sample clocks occurs is described in greater detail and possible consideration of a known period of time for transmission of a synchronization event is described in more detail. A clock master TM can transmit a synchronization word S by way of a bidirectional wireless transmission link preferably at regular spacings. The clock master TM can have a clock generator (for example 49.152 MHz). The output of the clock generator can be divided with a clock divider (for example 1024) to a sample clock of for example 48 kHz.

The process shown in FIG. 3 illustrates the conditions in the steady state, that is to say synchronization has already taken place so that the sample clock of the slave is already coordinated in respect of frequency and phase with the sample clock of the master. The synchronization procedure is described with reference to the steady state.

The clock master TM starts a first timer T1 when the synchronization word S is sent. After expiry of the first timer T1 the phase P1 of the sample clock S1 is measured. The measured phase P1 is transmitted to one or more clock slaves TS (for example by way of a broadcast channel BC). The clock slave TS receives the synchronization word S and starts a second timer T2. After expiry of the second timer T2 the phase P2 of the sample clock S2 of the clock slave TS is measured. When the clock slave TS receives the first phase P1 by way of the broadcast channel BC then the first and second phases P1, P2 are compared in a comparison unit C and the difference ascertained by the comparison represents the control difference in respect of the adjustable clock generator of the clock slave TS. That procedure can optionally be carried out upon the transmission of each synchronization word S. As an alternative thereto that can also be carried out after transmission of a number of synchronization words S.

According to an aspect of the invention the clock S1 can be provided in the master and the clock S2 can be provided in the slave. The timer T2 can run in the slave.

The step of sending the synchronization word S (starting the timer T1) until processing of that information in the slave and starting of the timer T2 requires a certain time which is symbolically shown in FIG. 3 as the width of the block S. It is very short in practice. Adjustment of the timers T1 and T2 in such a way that the expiry of both timers occurs at the same moment in time can only be effected with a limited accuracy as, because of different clocks in the master and in the slave, those timers are subject to certain slight fluctuations. Equally the time represented as the width of the block S has slight fluctuations. All those three alterations however are extremely slight in practice so that they involve no significance whatsoever in relation to the clock fluctuations for controlling the analog/digital converter in the master/slave. The displacement of the sample clocks is greater by orders of magnitude so that the slight time fluctuations of S, T1 and T2 do not matter in practice.

Figure 4:
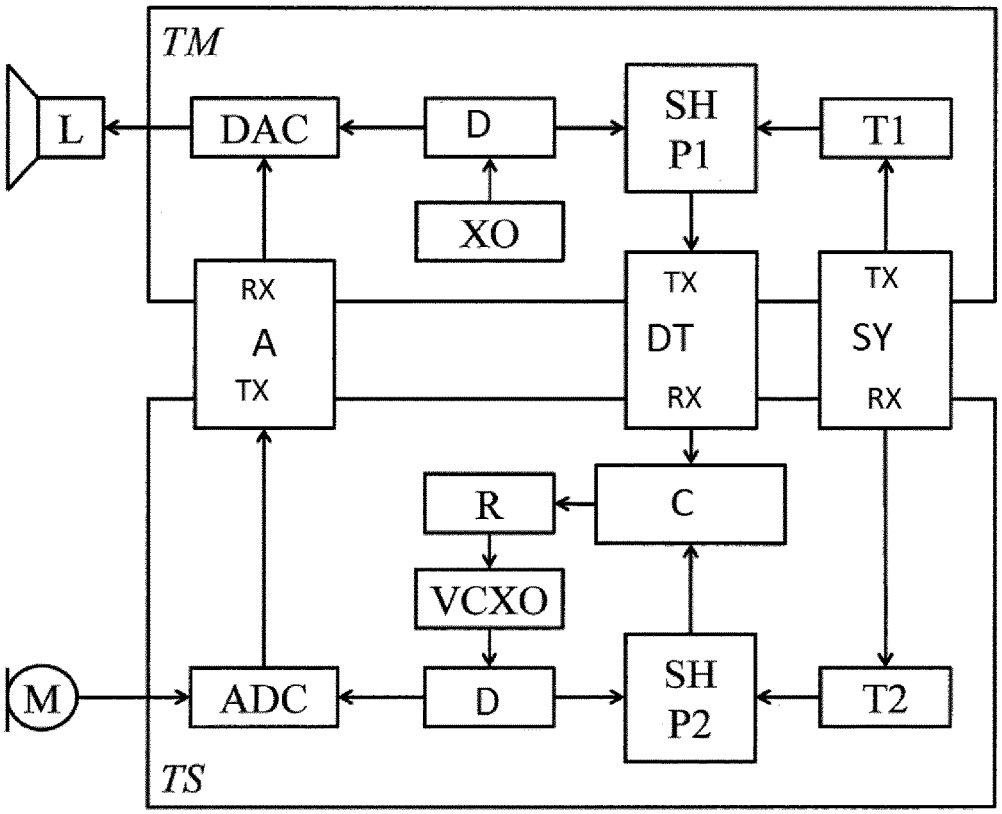
FIG. 4 shows a block circuit diagram of synchronization in a wireless microphone and/or in-ear monitoring system according to the second embodiment.

FIG. 4 shows a block circuit diagram of synchronization in a wireless microphone and/or in-ear monitoring system according to the second embodiment. According to the invention a clock slave TS has an adjustable clock generator (for example a VCXO with a clock divider D). A clock generator can be implemented for example in the form of a voltage control crystal oscillator VCXO or a digitally controlled crystal oscillator DCXO.

According to the invention the first and/or second timers T1, T2 are so adjusted that their expiry occurs at the same moment in time. In that case, in the synchronized state, the phase measured by the clock master TM and transmitted to the clock slave TS coincides with the phase of the clock slave. If there is a difference then that difference is to be controlled to zero by means of a controller R in the clock slave TS. A control variable of the controller can be the control signal of the adjustable clock generator VCXO in the clock slave TS.

The clock master TM can have a digital/analog converter DAC, a clock divider D, an oscillator XO, and a first sample-and-hold unit SHP1 for storage of the first phase. The first phase P1 can be transmitted by broadcast by way of a data transmission interface DT. The clock master TM can have an audio transmission interface A which transmits the audio data recorded by the microphone M and processed by the analog/digital converter ADC from the clock slave TS to the clock master TM. The clock master TM can also have a synchronization interface SY.

The clock slave TS can be coupled for example to a microphone M and receives the output signal of the microphone M. The output signal of the microphone can be digitized in an analog/digital converter DAC.

The clock slave TS has an adjustable oscillator VCXO, a clock division unit D, a second sample-and-hold unit SHP2, a comparison unit C, a second timer T2 and a controller R.

By way of the synchronization interface SY the clock master TM transmits the synchronization word RXS which is received by the clock slave TS. The second timer T2 is started upon reception of the synchronization word RXS. After expiry of the second timer T2 the second sample-and-hold unit SHP2 is used to store the second measured phase P2 of the clock slave TS. When data are transmitted by way of the data transmission interface DT then the first and second phases P1, P2 are compared in the comparison unit C. The output of the comparison unit C is an input signal of the control unit R. The output signal of the control unit R controls an adjustable clock generator VCXO. The output signal of the adjustable clock generator VCXO is divided by the clock divider unit D and fed to the analog/digital converter ADC which uses that clock as a sample clock for sampling the output signal of the microphone M. The correspondingly digitized output signal of the microphone M is transmitted by way of the audio interface A to the clock master TM which carries out digital/analog conversion in the digital/analog converter DAC and can then output the analog output signal for example to a loudspeaker L.

The invention thus concerns a bidirectional wireless transmission link with regular time synchronization of at least one clock slave to the clock master. A sending process in respect of the clock master and a receiving process in respect of the clock slave respectively start a timer to ensure an identical measurement time at all devices. At the measurement time the clock master measures a sample clock phase which is transmitted to all clock slaves. A clock slave measures a sample clock phase at the measurement time. That sample clock phase is compared to the received sample clock phase of the clock master. A difference is used to control an adjustable clock generator in the clock slave in such a way that that difference is controlled to zero.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A method of controlling a wireless microphone and/or in-ear monitoring system which has a master device as a clock master and at least one slave device as a clock slave, wherein between the clock master and the at least one clock slave there is a wireless digital transmission link, by way of which both synchronization signals and also audio signals can be digitally transmitted, comprising the steps:

prescribing a master audio sample clock which prescribes master audio sampling times in the clock master;

resetting a master phase counter each time as soon as the master audio sample clock prescribes a master audio sampling time;

forward counting of the master phase counter with the clock of a master fine clock generator;

prescribing an adjustable slave audio sample clock which prescribes slave audio sampling times in the clock slave;

resetting a slave phase counter each time as soon as the slave audio sample clock prescribes a sampling time;

forward counting of the slave phase counter with the clock of a slave fine clock generator;

generating a synchronization event which generates a fixed time relationship between the clock master and the clock slave;

establishing a synchronization time on the basis of the synchronization event so that the clock master and the clock slave simultaneously reach the synchronization time;

detecting a master phase from the master phase counter at the synchronization time;

detecting a slave phase from the slave phase counter at the synchronization time;

wirelessly transmitting the detected master phase to the at least one clock slave;

comparing the wirelessly transmitted master phase to the detected slave phase, wherein a difference between the master phase and the slave phase is detected;

using the difference between the master phase and the slave phase as an input value for a controller of the clock slave; and adjusting the adjustable slave audio sample clock by the controller so that after recurrent performance of simultaneous detection of the master phase and the slave phase and subsequent processing the slave phase corresponds to the master phase so that the slave audio sampling times correspond to the master audio sampling times.

2. The method of controlling a wireless microphone and/or in-ear monitoring system according to claim 1, comprising:

wherein the synchronization event is obtained from a wireless transmission between the master device and the slave device, wherein the synchronization event is independent of the audio sample clock.

3. A master device for a wireless microphone and/or in-ear monitoring system, to which the master device belongs as a clock master and at least one slave device belongs as a clock slave, comprising:

a master audio sample clock generator configured to generate a master audio sample clock that prescribes master audio sampling times;

a master fine clock generator configured to prescribe a master fine clock;

a master phase counter which counts forwards with the master fine clock and in so doing continuously generates a master counter state, wherein the master phase counter is reset each time as soon as the master audio sample clock prescribes a master audio sampling time;

a phase measurement trigger configured to generate a synchronization event, wherein the master device derives a synchronization time from the synchronization event, a phase measurement trigger transmitter configured to wirelessly transmit the synchronization event to the slave device, wherein a fixed time relationship is generated between the master device and the slave device;

a master phase value sensor which at the synchronization time reads out the current master counter state of the master phase counter and stores it as a master phase;

a phase transmitter configured to wirelessly transmit the read-out master phase to the slave device; and a master audio transmitter receiver, by way of which the master device is configured to wirelessly transmit, wirelessly receive, or wirelessly transmit and receive digital audio data which are associated with the master audio sample clock.

4. The master device for a wireless microphone and/or monitoring system as set forth in claim 3, additionally comprising:

a wordclock input and a master wordclock synchronization unit, by way of which the master audio sample clock can be adjusted to a wordclock signal of an external clock generator.

5. A slave device for a wireless microphone and/or in-ear monitoring system, to which a master device belongs as a clock master and at least the slave device belongs as a clock slave, comprising:

a slave audio sample clock generator configured to generate an adjustable slave audio sample clock which prescribes slave audio sampling times;

a slave fine clock generator configured to prescribe a slave fine clock;

a slave phase counter which counts forwards with the slave fine clock and in so doing continuously generates a slave counter state, wherein the slave phase counter is reset each time as soon as the slave audio sample clock prescribes a slave audio sampling time;

a measurement trigger receiver configured to receive a synchronization event from the master device, wherein a fixed time relationship between the master device and the slave device is generated and wherein the slave device derives from the synchronization event a synchronization time which corresponds to a synchronization time of the master device;

a slave phase value sensor which at the synchronization time reads out the current slave counter state of the slave phase counter and stores it as a slave phase;

a phase receiver configured to wirelessly receive a master phase from the master device;

a comparator configured to compare the wirelessly transmitted master phase to the detected slave phase, and to determine a difference between the master phase and the slave phase;

a controller which uses the difference between the master phase and the slave phase as an input value; and a slave audio transmitter receiver, by way of which the slave device is configured to wirelessly transmit, wirelessly receive, or wirelessly transmit and receive digital audio data associated with the slave audio sample clock;

wherein the controller so adjusts the adjustable slave audio sample clock as a variable in a control circuit that, after multiple execution cycles of the control circuit the slave phase, corresponds to the master phase so that the slave audio sampling times correspond to the master audio sampling times.

6. The slave device for a wireless microphone and/or in-ear monitoring system as set forth in claim 5;

wherein the control circuit is in the form of a phase locked loop.

7. A wireless microphone and/or in-ear monitoring system comprising:

a master device comprising:

a master audio sample clock generator configured to generate a master audio sample clock that prescribes master audio sampling times;

a master fine clock generator configured to prescribe a master fine clock;

a master phase counter which counts forwards with the master fine clock and in so doing continuously generates a master counter state, wherein the master phase counter is reset each time as soon as the master audio sample clock prescribes a master audio sampling time;

a phase measurement trigger configured to generate a synchronization event, wherein the master device derives a synchronization time from the synchronization event, a phase measurement trigger transmitter configured to wirelessly transmit the synchronization event to the slave device, wherein a fixed time relationship is generated between the master device and the slave device;

a master phase value sensor which at the synchronization time reads out the current master counter state of the master phase counter and stores it as a master phase;

a phase transmitter configured to wirelessly transmit the read-out master phase to the slave device; and a master audio transmitter receiver, by way of which the master device is configured to wirelessly transmit, wirelessly receive, or wirelessly transmit and receive digital audio data which are associated with the master audio sample clock; and at least one slave device comprising:

a slave audio sample clock generator configured to generate an adjustable slave audio sample clock which prescribes slave audio sampling times;

a slave fine clock generator configured to prescribe a slave fine clock;

a slave phase counter which counts forwards with the slave fine clock and in so doing continuously generates a slave counter state, wherein the slave phase counter is reset each time as soon as the slave audio sample clock prescribes a slave audio sampling time;

a measurement trigger receiver configured to receive a synchronization event from the master device, wherein a fixed time relationship between the master device and the slave device is generated and wherein the slave device derives from the synchronization event a synchronization time which corresponds to a synchronization time of the master device;

a slave phase value sensor which at the synchronization time reads out the current slave counter state of the slave phase counter and stores it as a slave phase;

a phase receiver configured to wirelessly receive a master phase from the master device;

a comparator configured to compare the wirelessly transmitted master phase to the detected slave phase, wherein a difference between the master phase and the slave phase is detected;

a controller which uses the difference between the master phase and the slave phase as an input value; and a slave audio transmitter receiver, by way of which the slave device is configured to wirelessly transmit, wirelessly receive, or wirelessly transmit and receive digital audio data associated with the slave audio sample clock;

wherein the controller so adjusts the adjustable slave audio sample clock as a variable in a control circuit that, after multiple execution cycles of the control circuit the slave phase, corresponds to the master phase so that the slave audio sampling times correspond to the master audio sampling times.

* * * * *